US008232508B1

(12) United States Patent
Milligan

(10) Patent No.: US 8,232,508 B1
(45) Date of Patent: Jul. 31, 2012

(54) WATER HEATER POWER CONTROL DEVICE

(76) Inventor: Loren Milligan, Baxter, IA (US)

( * ) Notice: Subject to any disclaimer, the term of this patent is extended or adjusted under 35 U.S.C. 154(b) by 979 days.

(21) Appl. No.: 12/179,460

(22) Filed: Jul. 24, 2008

(51) Int. Cl.
*H05B 1/02* (2006.01)

(52) U.S. Cl. ..... 219/483; 219/492; 236/46 R; 392/463

(58) Field of Classification Search ..... 219/492, 219/494, 497, 506, 491; 236/20 R, 46 R; 392/464, 449, 498
See application file for complete search history.

(56) References Cited

U.S. PATENT DOCUMENTS 4,737,615 A * 4/1988 Stipe ..... 392/454
6,208,806 B1 * 3/2001 Langford ..... 392/464
6,293,471 B1 * 9/2001 Stettin et al. ..... 236/20 R
7,504,749 B2 * 3/2009 Von Seidel ..... 307/131
2003/0178408 A1 * 9/2003 Ghent ..... 219/492

* cited by examiner

*Primary Examiner* — Mark Paschall
(74) *Attorney, Agent, or Firm* — Schmeiser, Olsen & Watts LLP

(57) ABSTRACT

A water heater power control device is provided, wherein the control device includes a device outlet adapted to receive an electric plug of a water heater and a timer in communication with the device outlet. The control device may further comprise an electric plug adapted to plug into a wall outlet and provide power to the device outlet and the timer. In particular aspects of the present invention, the device outlet is changeable between an on state and an off state in response to commands from the timer.

12 Claims, 2 Drawing Sheets

WATER HEATER POWER CONTROL DEVICE

BACKGROUND OF THE INVENTION

1. Technical Field

This invention relates generally to water heater power control device and more particularly to a water heater power control device that is programmable to set the times when the water heater is operable in a normal condition or inoperable.

2. State of the Art

The use of water heaters is prevalent in virtually every house, apartment or other dwelling. The ability to have hot water at any given time in a day has become expected and common. In order to provide hot water through out the day, the water heater will automatically heat the water within the tank of the water heater. There is no control over the frequency that the water is heated out side of the level of heat that is selectable by the user of the water heater.

Conventional water heaters will run periodically through out the day as hot water is used by those within the house or if the water temperature drops. While this functions to provide hot water at any particular time during a day, these conventional hot water heaters have their limitations.

For example, conventional hot water heaters do not provide for the ability to control times of operation. Conventional hot water heaters operate all day long without interruption.

Accordingly, there is a need for a water heater power control device adapted to control times of operation of a conventional water heater.

DISCLOSURE OF THE INVENTION

The water heater power control device of this invention has several features, no single one of which is solely responsible for its desirable attributes. Without limiting the scope of this invention as expressed by the claims that follow, its more prominent features will now be discussed briefly. The present invention relates to a water heater power control device, wherein the control device includes a device outlet and a timer in communication with the device outlet in order to establish times of operation of the water heater. Generally, a water heater power control device includes a device outlet to couple to a water heater electric plug and a timer in communication with the device outlet to control the operation of the device outlet.

An aspect of the present invention may include a water heater power control device comprising a device outlet adapted to receive an electric plug of a water heater and a timer in communication with the device outlet. The control device may further comprise an electric plug adapted to plug into a wall outlet and provide power to the device outlet and the timer. In particular aspects of the present invention, the device outlet is changeable between an on state and an off state in response to commands from the timer.

Another aspect of the present invention may include a water heater system comprising a water heater having an electric plug; a device outlet, wherein the electric plug is removably coupled to the device outlet; and a timer in communication with the device outlet. The system may further comprise an electric plug adapted to plug into a wall outlet and provide power to the device outlet and the timer. According to particular aspects of the present invention, the device outlet is changeable between an on state and an off state in response to commands from the timer.

Further still, another aspect of the present invention may include a method of using a water heater power control device. The method comprises connecting the water heater power control device between a water heater and a wall outlet; programming a timer of the water heater power control device; setting the timer in operational mode; and changing a device outlet of the water heater power control device between an on state and an off state in response to commands from the timer The foregoing and other features and advantages of the present invention will be apparent from the following more detailed description of the particular embodiments of the invention, as illustrated in the accompanying drawings.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

As discussed above, embodiments of the present invention relate to a water heater power control device, wherein the control device includes a device outlet and a timer in communication with the device outlet in order to establish times of operation of the water heater. Generally, a water heater power control device includes a device outlet to couple to a water heater electric plug and a timer in communication with the device outlet to control the operation of the device outlet.

Figure 1A:
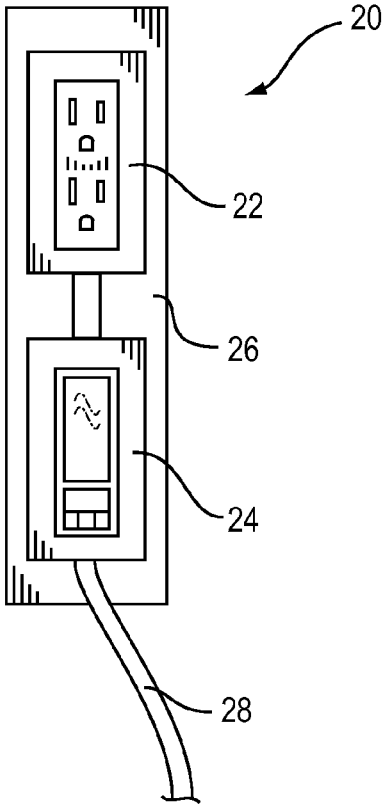
FIGS. 1A and 1B are top views of embodiments of a water heater power control device.
Figure 1B:
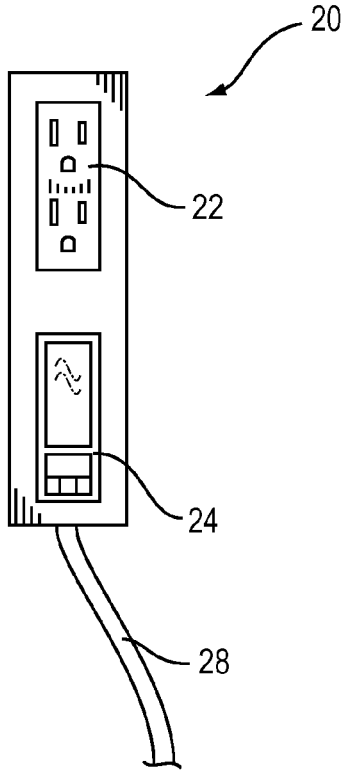

With reference to the drawings, FIGS. 1A-1B depicts a water heater power control device 20 in accordance with particular embodiments of the present invention. The control device 20 may include a device outlet 22, a timer 24 and an electric plug 28. The device outlet 22 and the timer 24 may be mounted onto a base 26 in accordance with particular embodiments of the present invention. In other embodiments, as shown in FIG. 1B, the device outlet 22 and the timer 24 may be integrally coupled together in one single unit. The electric plug 28 may be adapted to plug into a wall outlet and provide power to the device outlet 22 and the timer 24.

Figure 2:
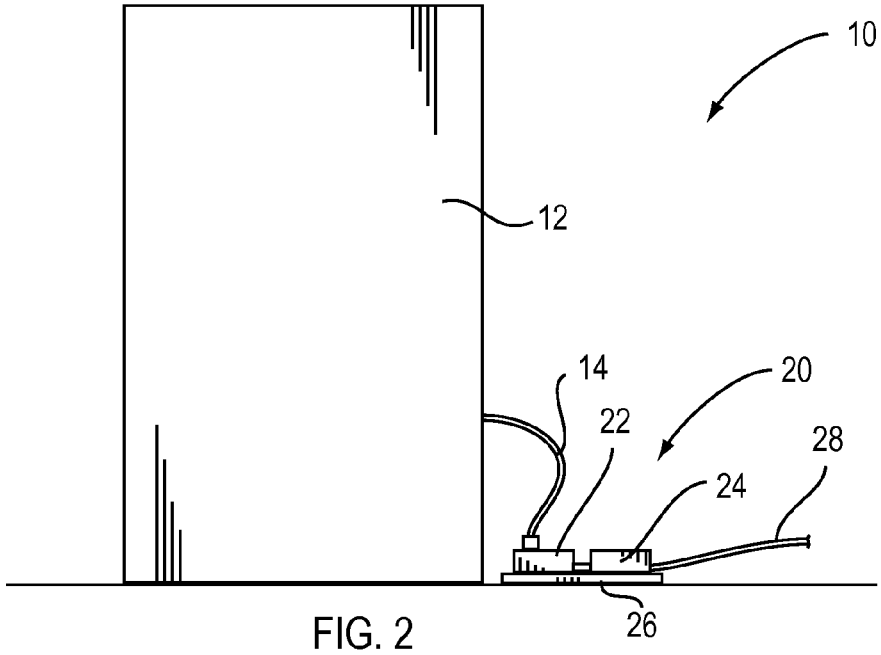
FIG. 2 is a side view of a water heater power control device connected to a water heater in accordance with the present invention.

The device outlet 22 may be adapted to receive an electric plug of a water heater, as shown in FIG. 2. The timer 24 may be in communication with the device outlet 22. This communication may include operating the device outlet 22 by controlling the operational state of the device outlet 22. The device outlet 22 is changeable between an on state and an off state in response to commands from the timer 24.

It will be understood that the timer 24 is type of programmable timer. In one embodiment, the timer 24 may be a programmable timer that may be programmed with a first time when the device outlet 22 is changed from an on state to and off state. The timer 24 may also be programmed with a second time when the device outlet 22 is changed from an off state to and on state. The controlling of the states of the device outlet will in turn control the power to the water heater. The power to the water heater will be on or off in response to the state of the device outlet 22 that is removably coupled to the electric plug of the water heater.

Further, the timer 24 may be a more complex timer wherein a plurality of times may be set to change the operational state of the device outlet 22. for example, the timer may include programming capability for programming multiple times in a day for turning changing the state of the device outlet 22, as well as having separate programs available for weekdays and weekends. This is particularly useful for households where the hot water usage changes dependent upon whether it is a weekday or a weekend. For example, a household that has occupants that work all day during weekdays may program the timer 24 to change the state of the device outlet 22 to an off state from 8 AM to 5 PM during the weekdays, but maintain the state of the device outlet 22 as an on state during the weekends in order to accomplish various household chores, projects and the like, including washing clothes, dishes, cleaning and any other project requiring the use of hot water.

Additionally, particular embodiments of the control device 20 may include the timer 24 that may be adapted to be manually overridden. This allows a user to change the state of the device outlet 22 at any time when needed. For example, the user may be sick or on vacation and needs to manually override the water heater control device in order to maintain the water heater in an operational state.

Figure 3:
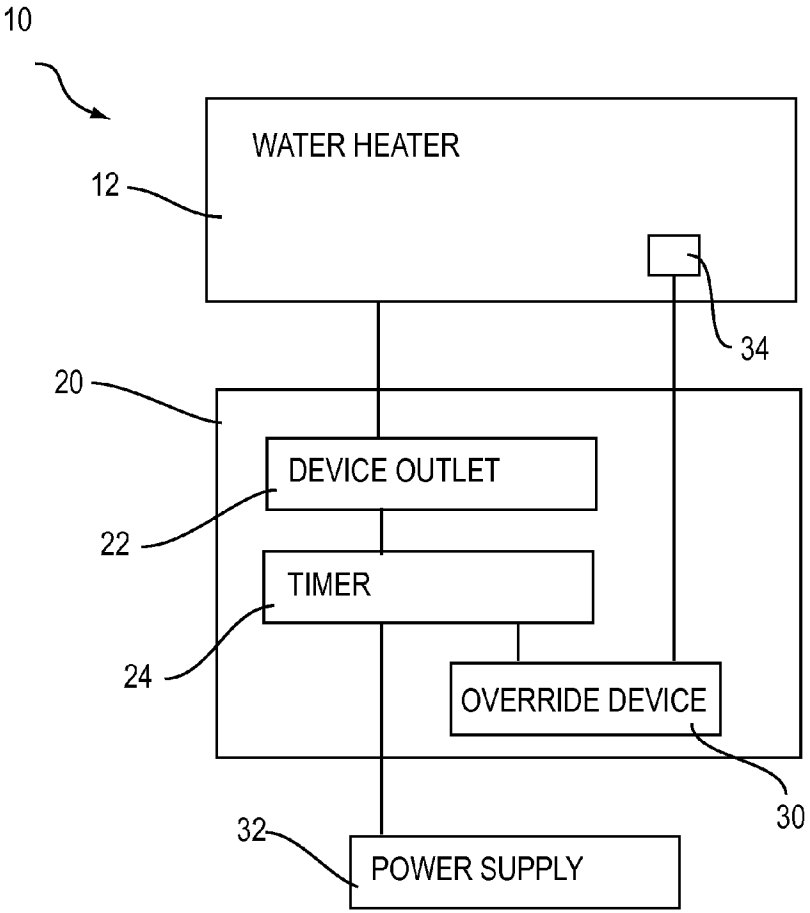
FIG. 3 is a schematic view of a water heater system in accordance with embodiments of the present invention.

Other embodiments of the present invention may include the control device 20 that further comprises an automated override device (as shown in FIG. 3). The automated override device may comprise a temperature measuring device. The temperature measuring device may be configured to measure the temperature of the water within the water heater. It will be understood that the temperature measuring device may any type of measuring device, including a thermometer, a thermocouple and the like.

Further, the automated override device may be adapted to override the water heater power control device 20, wherein the override device automatically changes the device outlet from the off state to the on state in response to a temperature measurement below a predetermined temperature level. Conversely, the automated override device may be adapted to override the water heater power control device 20, wherein the override device automatically changes the device outlet from the on state to the off state in response to a temperature measurement above a predetermined temperature level. The predetermined temperature level may be user selected. This automated override device is particularly useful in areas having extreme temperatures of cold or hot. For example, if the weather is such that the water in the water heater may freeze, the automated override device may have a temperature setting above the freezing level that would automatically change the state of the water heater control device 20 to an on state in order to heat the water in the tank and prevent freezing of the water and damage to the water heater due to the freezing of the water in the heater.

It will be understood that while it is shown that the water heater power control device 20 is mountable on a horizontal surface, such as a floor, the control device 20 may be mounted in a n angled position as well as a vertical position dependent upon the angle of the surface upon which the control device 20 is to be mounted.

Referring again to the drawings, FIGS. 2-3 depict a water heater system 10 in accordance with particular embodiments of the present invention. The water heater system may include a water heater 12 having an electric plug 14. The system 10 may further include a water heater power control device 20. The control device 20 may include a device outlet 22, a timer 24 and an electric plug 28. The device outlet 22 and the timer 24 may be mounted onto a base 26 in accordance with particular embodiments of the present invention. The electric plug 28 may be adapted to plug into a power supply 32 such as wall outlet and provide power to the device outlet 22 and the timer 24.

According to particular embodiments of the system 10, the device outlet 22 may be adapted to receive an electric plug 14 of a water heater 12. The timer 24 may be in communication with the device outlet 22. This communication may include operating the device outlet 22 by controlling the operational state of the device outlet 22. The device outlet 22 is changeable between an on state and an off state in response to commands from the timer 24.

It will be understood that the timer 24 is type of programmable timer. In one embodiment, the timer 24 may be a programmable timer that may be programmed with a first time when the device outlet 22 is changed from an on state to and off state. The timer 24 may also be programmed with a second time when the device outlet 22 is changed from an off state to and on state. The controlling of the states of the device outlet 22 will in turn control the power to the water heater 12. The power to the water heater 12 will be on or off in response to the state of the device outlet 22 that is removably coupled to the electric plug 14 of the water heater 12.

Further, the timer 24 may be a more complex timer wherein a plurality of times may be set to change the operational state of the device outlet 22. For example, the timer may include programming capability for programming multiple times in a day for turning changing the state of the device outlet 22, as well as having separate programs available for weekdays and weekends. This is particularly useful for households where the hot water usage changes dependent upon whether it is a weekday or a weekend. For example, a household that has occupants that work all day during weekdays may program the timer 24 to change the state of the device outlet 22 to an off state from 8 AM to 5 PM during the weekdays, but maintain the state of the device outlet 22 as an on state during the weekends in order to accomplish various household chores, projects and the like, including washing clothes, dishes, cleaning and any other project requiring the use of hot water.

Additionally, particular embodiments of the control device 20 may include the timer 24 that may be adapted to be manually overridden. This allows a user to change the state of the device outlet 22 at any time when needed. For example, the user may be sick or on vacation and needs to manually override the water heater control device in order to maintain the water heater in an operational state.

Other embodiments of the present invention may include the control device 20 that further comprises an automated override device 30. The automated override device 30 may comprise a temperature measuring device 34. The temperature measuring device 34 may be configured to measure the temperature of the water within the water heater 12. It will be understood that the temperature measuring device 34 may any type of measuring device, including a thermometer, a thermocouple and the like.

Further, the automated override device 30 may be adapted to override the water heater power control device 20, wherein the override device 30 automatically changes the device outlet 22 from the off state to the on state in response to a temperature measurement below a predetermined temperature level. Conversely, the automated override device 30 may be adapted to override the water heater power control device 20, wherein the override device 30 automatically changes the device outlet 22 from the on state to the off state in response to a temperature measurement above a predetermined temperature level. The predetermined temperature level may be user selected. This automated override device 30 is particularly useful in areas having extreme temperatures of cold or hot. For example, if the weather is such that the water in the water heater 12 may freeze, the automated override device 30 may have a temperature setting above the freezing level that would automatically change the state of the water heater control device 20 to an on state in order to heat the water in the tank and prevent freezing of the water and damage to the water heater 12 due to the freezing of the water in the heater 12.

It will be understood that while it is shown that the water heater power control device 20 is mountable on a horizontal surface, such as a floor, the control device 20 may be mounted in a n angled position as well as a vertical position dependent upon the angle of the surface upon which the control device 20 is to be mounted.

Figure 4:
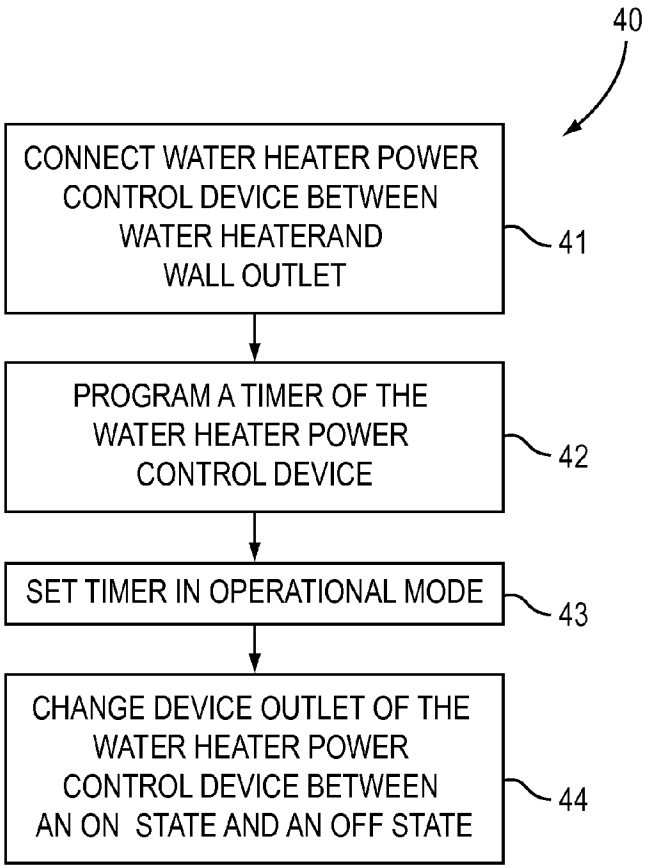
FIG. 4 is a flow chart of a method of using a water heater power control device.

Referring again to the drawings, FIG. 4 depicts a method 40 of using a water heater power control device. The method 40 may include the steps of connecting the water heater power control device between a water heater and a wall outlet (Step 41); programming a timer of the water heater power control device (Step 42); setting the timer in operational mode (Step 43); and changing a device outlet of the water heater power control device between an on state and an off state in response to commands from the timer (Step 44). Step 41 of programming the timer may further include programming a plurality of times to change the device outlet between the on state and the off state.

Additionally, method 40 may further comprise activating an automated override device of the water heater power control device, wherein automated override device automatically changes the device outlet from the off state to the on state in response to a temperature measurement of water within the water heater below a predetermined temperature level. Also, method 40 may comprise selecting the predetermined temperature level.

It will be understood that while the particular method steps are provide in a particular that the present invention is not limited to performing these method steps within this particular order. For example, and without limitation, Step 42 of programming the timer may be performed prior to Step 41 of connecting the control device between the water heater and the wall outlet.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The invention claimed is:

1. A water heater power control device comprising:
- a device outlet adapted to receive an electric plug of a water heater;
- a timer in communication with the device outlet;
- an electric plug adapted to plug into a wall outlet and provide power to the device outlet and the timer, wherein the device outlet is changeable between an on state and an off state in response to commands from the timer; and
- an automated override device comprising a temperature measuring device for measuring the temperature of the water within the water heater, wherein the override device automatically changes the device outlet from the off state to the on state in response to a temperature measurement below a predetermined temperature level.

2. The control device of claim 1, wherein the timer is programmable with a plurality of times to change the device outlet between the on state and the off state.

3. The control device of claim 2, wherein the timer is adapted to be manually overridden.

4. The control device of claim 1, wherein the predetermined temperature level is user selected.

5. The system of claim 2, wherein the timer may be manually overridden.

6. A water heater system comprising:
- a water heater having an electric plug;
- a device outlet, wherein the electric plug is removably coupled to the device outlet;
- a timer in communication with the device outlet;
- an electric plug removably coupled a wall outlet to provide power to the device outlet and the timer, wherein the device outlet is changeable between an on state and an off state in response to commands from the timer; and
- an automated override device comprising a temperature measuring device for measuring the temperature of the water within the water heater, wherein the override device automatically changes the device outlet from the off state to the on state in response to a temperature measurement below a predetermined temperature level.

7. The system of claim 6, wherein the timer is programmable with a plurality of times to change the device outlet between the on state and the off state.

8. The system of claim 6, wherein the predetermined temperature level is user selected.

9. A method of using a water heater power control device, the method comprising:
- connecting the water heater power control device between a water heater and a wall outlet;
- programming a timer of the water heater power control device;
- setting the timer in operational mode; and
- changing a device outlet of the water heater power control device between an on state and an off state in response to commands from the timer.

10. The method of claim 9, wherein programming the timer includes programming a plurality of times to change the device outlet between the on state and the off state.

11. The method of claim 9, further comprising activating an automated override device of the water heater power control device, wherein automated override device automatically changes the device outlet from the off state to the on state in response to a temperature measurement of water within the water heater below a predetermined temperature level.

12. The method of claim 11, further comprising selecting the predetermined temperature level.

* * * * *